United States Patent [19]

Petrovich

[11] 4,437,983

[45] Mar. 20, 1984

[54] FROTH FLOTATION METHOD FOR RECOVERING ZIRCONIUM MINERALS

[76] Inventor: Vojislav Petrovich, 1935 W. Schiller St., Chicago, Ill. 60622

[21] Appl. No.: 416,285

[22] Filed: Sep. 9, 1982

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS 2,251,217 7/1941 Woodhouse ..... 209/166

FOREIGN PATENT DOCUMENTS 137841 12/1960 U.S.S.R. ..... 209/167

*Primary Examiner*—Bernard Nozick

[57] ABSTRACT

An improved method in concentration of zirconium ores and minerals by froth flotation process which comprises subjecting a sufficiently fine sized ore of zirconium metal in the presence of phenethylglycolic acid or its sodium salt; or the like alkyl substituted phenylglycolic acid; the indicated compound provide selectivity and recovery of zirconium minerals over silica and silicate gangue.

2 Claims, No Drawings

FROTH FLOTATION METHOD FOR RECOVERING ZIRCONIUM MINERALS

This invention relates to froth flotation of zirconium ores using phenethylglycolic acid, or oleylphenylglycolic acid, or ricinoleylphenylglycolic acid, or their sodium salts as collector-frothers for recovering zirconium minerals from their ores, and particularly from beach sands and beach sand seams of earlier formations. Said acid are added after the grinding and sizing during the conditioning stage.

Accordingly, this invention has as an object the provision of a practical and economical process for the beneficiation of zirconium ores, i.e., either zirconium beach sands, or zirconium lode ores, which by the invented method are becoming amenable to froth flotation, which until now were concentrated by gravity method as mixed concentrate, which mixed concentrate is subjected to electrostatic preparation, concentrating zirconium mineral and separately the accessory minerals such as magnetite, ilmenite, rutile, etc. minerals. Another object of this invention is to provide a reagent specific to zirconium minerals, thus providing a concentration treatment for the beneficiation of zirconium mineral only with maximum recovery of said mineral with a relatively low consumption of reagents, from respective ores in floated froth formed by agitating and aerating the pulp of mineral slurry.

In said invention

Phenethylglycolic acid

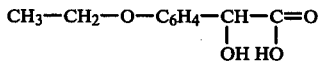

Oleylphenylglycolic acid

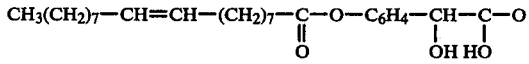

Ricinoleylphenylglycolic acid

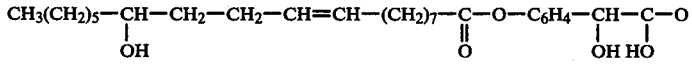

are applied with great success as well as the phenylglycolic acid in conjunction with a frother.

Thus, the active collecting group is represented with:

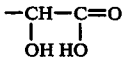

The glycolic acid alone is not capable to float zirconium minerals. An aryl compound must be connected to the glycolic acid such as phenyl, or naphthyl, phenethyl, or oleylphenol, i.e., a weight to the glycolic acid is needed to add. The lowest weight is phenyl group.

By applying the present invention it is feasible to obtain not only selected zirconium mineral as froth concentrate, but also an increased recovery of said metal value in froth concentrate with a reduction in reagent requirement and costs, a substantial advance is feasible in the field of zirconium recovery by froth flotation process by the method of this invention.

In carrying out this invention in accordance with the foregoing principle, the zirconium ore is ground sized and preferrably although not necessarily deslimed by washing to remove colloidally dispersed material, and thereafter the sands are diluted to a pulp consistency of generally about 25 percent solids. Thereafter the pulp is conditioned for several minutes by agitating with an amount of the order from 0.05 to 0.5 kg per ton of ore treated of phenethylglycolic acid or its sodium salt. Said addition to a pulp of mineral slurry with zirconium mineral produce a floating froth product of zirconium mineral. Besides a rougher a cleaner procedure may be employed and the invention can well be utilized in a cyclic process wherein the decanted and filtered spent water and the middling ore fraction are returned to the process, saving in this way the unused reagent, as well as omitting the spoiling of environment water courses. The invented process further reduces the need for close plant control in critical areas such as desliming, sizing, conditioning, and reagent rate reducing flotation reagent requirement and processing costs. Thus, efficient results and considerable reagent economy may be effected in the practicing this invention.

What is claimed is:

1. In concentrating by froth flotation of zirconium ores, which includes the subjecting of said ore material when finely ground to froth flotation process in the presence of alkylaryl and aryl glycolic acid or its sodium salt promoter-collector; the step of adding to the mineral slurry an amount of the order from 0.05 to 0.5 kg per ton of ore treated of said alkylaryl or aryl glycolic acid sodium salt; said addition to aqueous dispersion of ore produce a froth flotation product of zirconium mineral value by continuing agitation and aeration of the aqueous dispersion of ore, and separating and recovering the zirconium mineral value as float froth concentrate product.

2. According to claim 1, in which said alkylaryl or aryl glycolic acid of which the generic formula is:

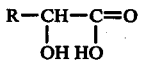

wherein R is selected from the group of aryl and alkylaryl residue; R consist of phenyl, naphthyl, phenethyl, oleylphenyl, ricinoleylphenyl.

* * * * *